United States Patent [19]

Yoshimura et al.

[11] Patent Number: 4,636,252

[45] Date of Patent: Jan. 13, 1987

[54] METHOD OF MANUFACTURING A HIGH TOUGHNESS CERMET FOR USE IN CUTTING TOOLS

[75] Inventors: Hironori Yoshimura; Jhunichi Toyama, both of Tokyo, Japan

[73] Assignee: Mitsubishi Kinzoku Kabushiki Kaisha, Tokyo, Japan

[21] Appl. No.: 609,892

[22] Filed: May 14, 1984

[30] Foreign Application Priority Data

May 20, 1983 [JP] Japan ..... 58-88699

[51] Int. Cl.[4] ..... C22C 29/04

[52] U.S. Cl. ..... 75/238; 75/241; 75/242; 419/13; 419/16; 419/32; 419/33; 419/48; 419/57; 428/552; 428/570; 428/623; 428/627

[58] Field of Search ..... 419/13, 15, 39, 57, 419/16, 32, 33, 48; 75/238, 241, 242; 428/552, 520, 623, 627

[56] References Cited

U.S. PATENT DOCUMENTS

| | | | |
|---|---|---|---|
| 3,409,419 | 11/1968 | Yates | 75/238 |
| 3,741,733 | 6/1973 | Kieffer | 75/238 |
| 3,916,497 | 11/1975 | Doi et al. | 75/236 |
| 4,019,874 | 4/1977 | Moskowitz | 75/241 |
| 4,046,517 | 9/1977 | Soga | 75/238 |
| 4,049,876 | 9/1977 | Yamamoto et al. | 75/238 |
| 4,276,096 | 6/1981 | Kolaska et al. | 75/238 |
| 4,330,333 | 5/1982 | Gibbs | 419/16 |
| 4,447,263 | 5/1984 | Sugizawa et al. | 419/16 |
| 4,514,224 | 4/1985 | Nishigaki | 75/236 |
| 4,521,248 | 6/1985 | Yamamoto et al. | 75/238 |

FOREIGN PATENT DOCUMENTS 151448 9/1983 Japan .

*Primary Examiner*—Stephen J. Lechert, Jr.

*Attorney, Agent, or Firm*—Frishauf, Holtz, Goodman & Woodward

[57] ABSTRACT

A method of manufacturing a cermet having high toughness and high hardness, which exhibits excellent impact resistance and wear resistance when used in cutting tools. A mixed powder is prepared which consists essentially of: titanium nitride, from 25 to 50 percent by weight; titanium carbide, from 10 to 30 percent by weight; at least one selected from the group consisting of tantalum carbide, niobium carbide, and zirconium carbide, from 5 to 25 percent by weight; tungsten carbide, from 10 to 25 percent by weight; and at least one selected from the group consisting of Co and Ni, and Al if required, from 7.5 to 25 percent by weight in total. The above mixed powder is compressed into a green compact. The green compact is sintered in a nitrogen atmosphere under a pressure within a range from 0.1 to 100 torr, and at a temperature within a range from 1400° to 1550° C. In the resulting cermet, the hard disperse phase has a cored structure which is formed by an NaCl-type solid solution phase having a centered structure with titanium carbide at the center surrounded by a solid solution of at least one selected from the group consisting of tantalum carbide, niobium carbide, and zirconium carbide, tungsten carbide, titanium carbide, and titanium nitride, and by a titanium nitride phase.

15 Claims, No Drawings

METHOD OF MANUFACTURING A HIGH TOUGHNESS CERMET FOR USE IN CUTTING TOOLS

BACKGROUND OF THE INVENTION

This invention relates to a method of manufacturing a cermet having high toughness and high hardness, and more particularly to a method of manufacturing a cermet of this kind, which exhibits excellent impact resistance and wear resistance when used in cutting tools.

Conventionally, cermets composed mainly of titanium carbide (hereinafter called "TiC" unless otherwise specified) have generally been used as materials for cutting tools. However, since these conventional TiC-base cermets are not satisfactory in respect of toughness, various studies have been made in an attempt to improve the toughness of the TiC-base cermets. In the circumstances, TiC-base cermets which contain titanium nitride (hereinafter called "TiN" unless otherwise specified) have drawn attention because of their improved toughness. It has been recognized that the reason for the improved toughness of such TiC-base cermets containing TiN lies in the fact that TiN acts to restrain the growth of grains in the cermet that would occur during the sintering process. However, in a TiC-base cermet having a high TiN content, the TiN can be decomposed if the green compact is subjected to sintering in a vacuum. The nitrogen gas from the decomposed TiN remains in the sintered cermet and forms pores therein, impeding improvement of the toughness of the TiC-base cermet. Therefore, the maximum possible TiN content in the conventional TiC-base cermets only ranges from 10 to 20 percent by weight (hereinafter percentages of the component elements are weight percentages), and such low TiN content cannot contribute to satisfactory improvement of the toughness of the TiC-base cermet.

OBJECT AND SUMMARY OF THE INVENTION

It is the object of the invention to provide a method of manufacturing a high toughness cermet for use in cutting tools, which can permit the cermet to have a high TiN content but is free from decomposition of TiN during its sintering step, and accordingly can impart to the cermet high toughness and high hardness enough to exhibit excellent impact resistance and wear resistance when used in cutting tools.

The present invention provides a method of manufacturing a high toughness cermet for use in cutting tools, which comprises the following steps:

(a) preparing a mixed powder consisting essentially of:
- titanium nitride, from 25 to 50 percent;
- titanium carbide, from 10 to 30 percent;
- at least one selected from the group consisting of tantalum carbide, niobium carbide, and zirconium carbide, from 5 to 25 percent;
- tungsten carbide, from 10 to 25 percent; and
- at least one selected from the group consisting of Co and Ni, and Al if required, from 7.5 to 25 percent in total;

(b) compressing the above mixed powder into a green compact; and (c) sintering the above green compact in a nitrogen atmosphere under a pressure within a range from 0.1 to 100 torr, and at a temperature within a range from 1400° to 1550° C.

The resulting cermet has a hard disperse phase which comprises two phases namely a first phase having a core/shell structure which is formed of a NaCl-type solid solution phase with titanium carbide at the center surrounded by a solid solution of tungsten carbide, titanium carbide, titanium nitride, and at least one compound selected from the group consisting of tantalum carbide, niobium carbide, and zirconium carbide, and a titanium nitride second phase. The cermet also has a binder phase. If Al is contained, the binder phase comprises at least one metal selected from the group consisting of Co and Ni, in which are dispersively present fine grains of intermetallic compounds of Al, Ti and at least one selected from the group consisting of Co and Ni.

DETAILED DESCRIPTION

Under the aforementioned circumstances, the present applicants have made many studies in order to manufacture a cermet which contains TiN in a large amount and is free from decomposition of TiN during the sintering process, so as to exhibit excellent toughness. As a result, the applicants have reached the following findings:

A cermet can have excellent properties, if it is manufactured by the following steps: preparing a mixed powder consisting essentially of:
- TiN, from 25 to 50 percent;
- TiC, from 10 to 30 percent;
- at least one selected from the group consisting of tantalum carbide, niobium carbide, and zirconium carbide (hereinafter called "TaC", "NbC", and "ZrC", respectively), from 5 to 25 percent;
- tungsten carbide (hereinafter called "WC"), from 10 to 25 percent; and
- at least one selected from the group consisting of Co and Ni, and Al if required (hereinafter these will be generically called "binder metals"), from 7.5 to 25 percent in total;
- compressing the above mixed powder into a green compact; and
- sintering the above green compact in a nitrogen atmosphere under a pressure within a range from 0.1 to 100 torr, andat a temperature within a range from 1400° to 1550° C.

In the resulting cermet, the hard disperse phase which comprises a first phase which has a core/shell structure which is formed (1) a NaCl-type solid solution phase with TiC at the center surrounded by a solid solution of WC, TiC, TiN and compound at least one selected from the group consisting of TaC, NbC, and ZrC, and a TiN second phase, and wherein the TiN is dispersed both in the NaCl-type solid solution phase and the TiN phase. By virtue of the above distribution of TiN, there occurs no decomposition of TiN during the sintering step, which would otherwise result in formation of pores. Further, both of the NaCl-type solid solution phase and the TiN phase forming the above hard disperse phase act to restrain the growth of grains. Also, the binder phase is strengthened by W dissolved therein. Thus, the cermet can have excellent toughness. Furthermore, because of the small Al content if Al is contained, fine grains of intermetallic compounds of Al and (i) at least one metal selected from the group consisting of Co and Ni, and (ii) Ti are dispersingly precipitated in the binder phase, improving the strength of the binder phase. Therefore, the cermet according to the invention can exhibit excellent impact resistance and wear resistance when used in cutting tools.

The present invention is based upon the above findings.

In the method according to the invention, the composition and the sintering conditions, i.e. the pressure of the sintering nitrogen atmosphere and the sintering temperature have been limited in the previously stated manner for the following reasons:

A. Composition (a) TiN:

The TiN acts to enhance the toughness and hardness of the cermet, mainly due to its grain growth-restraining action. However, if the TiN content is below 25 percent, there will be no TiN phase in the cermet. Such cermet devoid of a TiN phase is inferior in toughness and wear resistance to a cermet having a TiN phase. On the other hand, if TiN is contained in excess of 50 percent, there occurs decomposition of TiN during the sintering step, and the resulting nitrogen forms pores in the cermet, which greatly deteriorate the toughness of the cermet. Therefore, the TiN content has been limited to a range from 25 to 50 percent. Best results can be obtained if the TiN content falls within a range from 30 to 45 percent.

(b) TiC:

The TiC acts to enhance the wear resistance of the cermet because of its own high hardness. However, if the TiC content is below 10 percent, the above action cannot be performed to a required extent, due to a relatively small ratio of the NaCl-type solid solution phase. On the other hand, if TiC is contained in excess of 30 percent, the resulting relatively large ratio of the NaCl-type solid solution phase deteriorates the toughness of the cermet. Therefore, the TiC content has been limited to a range from 10 to 30 percent. Best results can be obtained if the TiC content falls within a range from 15 to 25 percent.

(c) WC:

Most of the WC is dissolved in the NaCl-type solid solution phase to enhance the toughness of the cermet, while the remainder of the WC is dissolved in the binder phase to enhance the strength of the binder phase. However, if the WC content is below 10 percent, the enhancement of the toughness of the cermet and the strength of the binder phase cannot be obtained to a required extent. On the other hand, if the WC content exceeds 25 percent, there will be formed a WC phase in the hard disperse phase, deteriorating the wear resistance of the cermet. Therefore, the WC content has been limited to a range from 10 to 25 percent. Best results can be obtained if the WC content falls within a range from 10 to 20 percent.

(d) TaC, NbC, and ZrC:

These ingredients act to enhance the resistance to plastic deformation of the cermet. However, if the total content of TaC, NbC and/or ZrC is below 5 percent, the above action cannot be performed to a required extent. On the other hand, if the total content is in excess of 25 percent, the wear resistance of the cermet can be deteriorated. Therefore, the total content of TaC, NbC and/or ZrC has been limited to a range from 5 to 25 percent. Best results can be obtained if the total content of these ingredients falls within a range from 10 to 15 percent.

(e) Binder Metals:

These ingredients form the binder phase of the cermet, and act to enhance the toughness of the cermet. However, if the total content of the combined metals is below 7.5 percent, the above action cannot be performed to a required extent. On the other hand, if they are contained in excess of 25 percent in total, the ratio of the binder phase will be large as compared with the disperse phase, resulting in deterioration of the wear resistance of the cermet. Therefore, the total content of the binder metals has been limited to a range from 7.5 percent to 25 percent. Best results can be obtained if the total content of the binder metals falls within a range from 12 to 20 percent. If Al is contained, the Al acts to form intermetallic compounds in cooperation with the binder metals, namely Co and/or Ni, and Ti to further enhance the strength of the binder phase. Preferably, the Al content should be from 0.01 to 1 percent.

B. Pressure of the Sintering Nitrogen Atmosphere

The sintering atmosphere should be a nitrogen atmosphere. However, if the pressure of the sintering nitrogen atmosphere is below 0.1 torr, the TiN can be decomposed in a large amount so that no TiN phase is present in the hard disperse phase of the cermet, resulting in almost no improvement in the wear resistance and toughness of the cermet. On the other hand, if the pressure of the sintering atmosphere exceeds 100 torr, there occurs a nitride layer on the surface of the sintered cermet, deteriorating the impact resistance of the cermet. Therefore, the pressure of the sintering nitrogen atmosphere has been limited to a range from 0.1 to 100 torr. Best results can be obtained if the pressure falls within a range from 1 to 10 torr.

C. Sintering Temperature

If the sintering temperature is below 1400° C., the sintering of the cermet cannot be performed to a required extent, causing residual pores in the cermet, which results in deterioration of the toughness of the cermet. On the other hand, if the sintering temperature exceeds 1550° C., a great deal amount of TiN can be decomposed during sintering such that the resulting nitrogen gas forms pores in the cermet, which results in deterioration of the toughness of the cermet. Therefore, the sintering temperature has been limited to a range from 1400° to 1550° C. Best results can be obtained if the sintering temperature falls within a range from 1430° to 1480° C.

An example of the method according to the invention will be given hereinbelow.

EXAMPLE

The following starting powders were prepared: powder of TiN having a mean grain size of 1.5 μm, powder of TiC having a mean grain size of 2.0 μm, powder of TaC having a mean grain size of 1.0 μm, powder of NbC having a mean grain size of 1.4 μm, powder of ZrC having a mean grain size of 2.2 μm, powder of WC having a mean grain size of 0.8 μm, powder of Co having a mean grain size of 1.2 μm, powder of Ni having a mean grain size of 2.5 μm, and powder of an Ni-Al alloy having a mean grain size of 2.7 μm, of which the Al content is 31 percent. These starting powders were blended into composition shown in Table 1. Each of the blended powders was subjected to wet pulverization and mixing in a ball mill for 72 hours, then dried, and compressed under a pressure of 15 kg/mm$^2$ into a green compact. Then, the green compact was sintered under conditions shown in Table 1, to obtain cermets Nos. 1–17 according to the present invention and comparative cermets Nos. 1–11. The comparative cermets Nos.

1–11 each have at least one of its components contained in an amount falling outside the range of the present invention, or one of its sintering conditions not satisfying the corresponding condition of the present invention, whose content or condition value is asterisked in Table 1.

TABLE 1

| Specimen | | COMPOSITION (% BY WEIGHT) TiN | TiC | TaC | NbC | ZrC | WC | Co | Ni | Al | SINTERING CONDITIONS PRESSURE (torr) | TEMPERATURE (°C.) | TIME (hr) |
|---|---|---|---|---|---|---|---|---|---|---|---|---|---|
| CERMETS ACCORDING TO THE PRESENT INVENTION | 1 | 25 | 30 | 10 | — | — | 18 | 10 | 7 | — | 0.2 | 1420 | 1.5 |
| | 2 | 35 | 20 | 10 | — | — | 18 | 12 | 5 | — | 1 | 1450 | |
| | 3 | 40 | 20 | 10 | — | — | 13 | 12 | 5 | — | 3 | 1480 | 1 |
| | 4 | 50 | 10 | 10 | — | — | 13 | 14 | 3 | — | 80 | 1520 | |
| | 5 | 40 | 20 | 5 | — | — | 17 | 12.9 | 5 | 0.1 | 4 | 1480 | |
| | 6 | 35 | 10 | 25 | — | — | 12 | 12.7 | 5 | 0.3 | 0.5 | 1450 | 1.5 |
| | 7 | 30 | 15 | 12 | — | — | 25 | 12.7 | 5 | 0.3 | 1 | | |
| | 8 | 40 | 20 | 10 | — | — | 10 | 9.5 | 9.5 | 1.0 | 3 | 1480 | 1 |
| | 9 | 35 | 25 | — | 10 | — | 13 | 12 | 5 | — | 3 | 1480 | 1 |
| | 10 | 40 | 20 | — | 5 | 1 | 16 | 9 | 9 | — | | | |
| | 11 | 35 | 20 | 10 | 5 | — | 12 | 12.9 | 5 | 0.1 | 10 | 1450 | 1.5 |
| | 12 | 35 | 20 | 10 | 5 | 1 | 10 | 11.3 | 7 | 0.7 | | | |
| | 13 | 30 | 25 | 10 | 5 | — | 10 | 8.8 | 10 | 1.2 | | | |
| | 14 | 35 | 20 | 10 | — | — | 20 | 14.95 | — | 0.05 | 0.5 | | |
| | 15 | 35 | 20 | 15 | — | — | 18 | 12 | — | — | | | |
| | 16 | 35 | 20 | 10 | — | — | 20 | — | 14.95 | 0.05 | 50 | | |
| | 17 | 35 | 20 | 15 | — | — | 18 | — | 12 | — | 0.5 | | |
| COMPARATIVE CERMETS | 1 | 20* | 35* | 10 | — | — | 18 | 10 | 7 | — | 0.2 | 1420 | 1.5 |
| | 2 | 55* | 5* | 10 | — | — | 13 | 14 | 3 | — | 8 | 1570* | 1 |
| | 3 | 30 | 30 | —* | —* | —* | 23 | 12 | 5 | — | 1 | 1480 | 1.5 |
| | 4 | 30 | 10 | 30* | — | — | 13 | 12 | 5 | — | 0.5 | 1450 | |
| | 5 | 30 | 30 | 18 | — | — | 5* | 12 | 5 | — | 1 | | |
| | 6 | 30 | 10 | 13 | — | — | 30* | 12 | 5 | — | 4 | | |
| | 7 | 30 | 20 | 25 | — | — | 20 | 5* | — | — | 1 | | |
| | 8 | 30 | 20 | 10 | — | — | 10 | 24.5* | 5* | 0.5 | | | |
| | 9 | 40 | —* | 25 | — | — | 15 | 14.5 | 5 | 0.5 | 3 | 1480 | 1 |
| | 10 | 40 | 20 | 10 | — | — | 10 | 12.3 | 7 | 0.7 | $10^{-2}$* | | |
| | 11 | 35 | 10 | 10 | — | — | 25 | 12.3 | 7 | 0.7 | 150* | | |

*falls outside the range of the present invention

Then, the cermets Nos. 1–17 according to the present invention and the comparative cermets Nos. 1–11 had their structures examined. The examination revealed that while the cermets Nos. 1–17 according to the present invention and the comparative cermets Nos. 2–5, and 7–10 each have its hard disperse phase having a cored structure formed by an NaCl-type solid solution phase and a TiN phase, the comparative cermet No. 1, whose TiN content is lower than the TiN content range of the present invention and whose TiC content is higher than the TiC content the range of the present invention, has no TiN phase formed therein, and also the comparative cermet No. 6 whose WC content is higher than the WC content range of the present invention and the comparative cermet No. 11 which was sintered in a nitrogen ($N_2$) atmosphere under a pressure higher than the pressure range of the present invention both have WC phases formed therein. Further, the cermets Nos. 1–17 according to the present invention and the comparative cermets Nos. 1–11 were tested with respect to formation of pores (ASTM) and hardness (Rockwell Hardness: A scale), and also with respect to transverse rupture strength in order to evaluate the toughness. Then, they were each cut into the form of a cutting insert, and the cutting inserts were subjected to a continuous cutting test by a steel bar and an intermittent cutting test by a steel block, under the following conditions:

CONTINUOUS CUTTING TEST

Work Material: JIS SNCM-8 (hardness: $H_B$240);
Cutting Speed: 200 m per minutes;
Feed Rate: 0.36 mm per rev.;
Depth of Cut: 2 mm;
Cutting Time: 10 minutes

INTERMITTENT CUTTING TEST

Work Material: JIS SNCM-8 (hardness: $H_B$270);
Cutting Speed: 140 m per minute;
Feed Rate: 0.3 mm per rev.;
Depth of Cut: 2 mm;
Cutting time: 3 minutes In the above continuous cutting test, the flank wear and crater wear of each cutting insert were measured, whereas in the above intermittent cutting test, it was checked how many of ten cutting inserts tested was chipped during testing. The results of the measurement and checking are shown in Table 2. Further in Table 2 are also shown the results of the same cutting tests as above which were conducted on a TiC-base cermet sold on the market (hereinafter called "the conventional cermet No. 1") and a TiC-base cermet also on the market, whose TiN content is 15 percent (hereinafter called "the conventional cermet No. 2"), under same conditions as above.

TABLE

| CERMET SPECIMEN | | PROPERTIES FORMATION OF PORES | HARDNESS ($H_RA$) | TRANSVERSE RUPTURE STRENGTH (Kg/mm$^2$) | CONTINUOUS CUTTING FLANK WEAR (mm) | CRATER WEAR (μm) | INTERMITTENT CUTTING NUMBER OF CHIPPED INSERTS/NUMBER OF TESTED INSERTS |
|---|---|---|---|---|---|---|---|
| CERMETS | 1 | below | 91.0 | 155 | 0.15 | 40 | 1/10 |

TABLE -continued

| CERMET SPECIMEN | | PROPERTIES FORMATION OF PORES | HARDNESS ($H_RA$) | TRANSVERSE RUPTURE STRENGTH ($Kg/mm^2$) | CONTINUOUS CUTTING FLANK WEAR (mm) | CONTINUOUS CUTTING CRATER WEAR ($\mu m$) | INTERMITTENT CUTTING NUMBER OF CHIPPED INSERTS/NUMBER OF TESTED INSERTS |
|---|---|---|---|---|---|---|---|
| ACCORDING TO THE PRESENT INVENTION | 2 | A-1 below | 91.4 | 165 | 0.11 | 30 | 0/10 |
| | 3 | A-1 below | 91.2 | 162 | 0.10 | 20 | 0/10 |
| | 4 | A-1 | 91.0 | 139 | 0.15 | 10 | 2/10 |
| | 5 | A-1 below | 91.2 | 156 | 0.12 | 20 | 0/10 |
| | 6 | A-1 below | 91.1 | 154 | 0.10 | 30 | 1/10 |
| | 7 | A-1 below | 91.0 | 158 | 0.17 | 40 | 1/10 |
| | 8 | A-1 below | 91.0 | 147 | 0.08 | 15 | 2/10 |
| | 9 | A-1 below | 91.2 | 157 | 0.12 | 20 | 1/10 |
| | 10 | A-1 below | 91.3 | 148 | 0.11 | 20 | 2/10 |
| | 11 | A-1 below | 91.3 | 158 | 0.09 | 20 | 1/10 |
| | 12 | A-1 below | 91.4 | 145 | 0.08 | 20 | 2/10 |
| | 13 | A-1 below | 91.5 | 140 | 0.08 | 15 | 3/10 |
| | | A-1 | 91.5 | 140 | 0.08 | 15 | 3/10 |
| | 14 | A-1 below | 91.7 | 148 | 0.09 | 30 | 1/10 |
| | 15 | A-1 below | 92.2 | 135 | 0.07 | 20 | 3/10 |
| | 16 | A-1 below | 91.0 | 140 | 0.09 | 25 | 2/10 |
| | 17 | A-1 below | 91.5 | 133 | 0.07 | 15 | 3/10 |
| COMPARATIVE CERMETS | 1 | A-1 below | 90.8 | 120 | 0.26 | 80 | 7/10 |
| | 2 | A-5 | 90.0 | 97 | chipped after 2 min. | | 10/10 |
| | 3 | A-1 below | 90.9 | 115 | 0.24 | 60 | 8/10 |
| | 4 | A-1 below | 91.0 | 118 | 0.28 | 70 | 7/10 |
| | 5 | A-1 below | 90.7 | 122 | 0.20 | 40 | 9/10 |
| | 6 | A-1 below | 90.6 | 129 | 0.32 | 100 | 6/10 |
| | 7 | A-1 below | 92.5 | 94 | chipped after 5 min. | | 10/10 |
| | 8 | A-1 below | 88.7 | 150 | plastically deformed after 1 min. | | 3/10 |
| | 9 | A-1 below | 90.3 | 98 | chipped after 6 min. | | 10/10 |
| | 10 | A-4 | 90.1 | 108 | 0.25 | 60 | 8/10 |
| | 11 | A-3 | 90.2 | 111 | 0.27 | 50 | 7/10 |
| CONVENTIONAL CERMETS | 1 | — | — | — | 0.39 | 80 | 10/10 |
| | 2 | — | — | — | 0.30 | 70 | 8/10 |

It will be learned from Table 2 that the cermets Nos. 1–17 according to the present invention each show excellent values in respect of both hardness and toughness, and have exhibited excellent wear resistance and excellent impact resistance as a result of the cutting tests, while the comparative cermets Nos. 1–11 and the conventional cermets Nos. 1 and 2 are all inferior to the cermets according to the present invention in respect of at least one of the above properties. Particularly in the intermittent cutting test, all the comparative cermets and conventional cermets showed inferior test results to the cermets according to the present invention, except the comparative cermet No. 8 whose content of binder metals is higher than the range of the present invention.

What is claimed is:

1. A method of manufacturing a cermet having high toughness for use in cutting tools, comprising the steps of:

(a) preparing a mixed powder consisting essentially of:

titanium nitride, from 25 to 50 percent by weight;

titanium carbide, from 10 to 30 percent by weight;

at least one compound selected from the group consisting of tantalum carbide, niobium carbide, and zirconium carbide, from 5 to 25 percent by weight;

tungsten carbide, from 10 to 25 percent by weight; and at least one metal selected from the group consisting of Co and Ni, from 7.5 to 25 percent by weight;

(b) compressing said mixed powder into a green compact; and (c) sintering said green compact in a nitrogen atmosphere under a pressure within a range from 0.1 to 100 torr, and at a temperature within a range from 1400° to 1550° C.

2. A method of manufacturing a cermet having high toughness for use in cutting tools, comprising the steps of:

(a) preparing a mixed powder consisting essentially of:

titanium nitride, from 25 to 50 percent by weight;

titanium carbide, from 10 to 30 percent by weight;

at least one compound selected from the group consisting of tantalum carbide, niobium carbide, and zirconium carbide, from 5 to 25 percent by weight;

tungsten carbide, from 10 to 25 percent by weight; and

Al and at least one metal selected from the group consisting of Co and Ni, from 7.5 to 25 percent by weight in total;

(b) compressing said mixed powder into a green compact; and (c) sintering said green compact in a nitrogen atmosphere under a pressure within a range from 0.1 to 100 torr, and at a temperature within a range from 1400° to 1550° C.

3. The method as claimed in claim 1 or claim 2, wherein said titanium nitride is in an amount from 30 to 45 percent by weight.

4. The method as claimed in claim 1 or claim 2, wherein said titanium carbide is in an amount within a range from 15–25 percent by weight.

5. The method as claimed in claim 1 or claim 2, wherein said at least one compound selected from the group consisting of tantalum carbide, niobium carbide and zirconium carbide is in an amount from 10 to 15 percent by weight.

6. A method as claimed in claim 1 or claim 2, wherein said tungsten carbide is contained in an amount within a range from 10 to 20 percent by weight.

7. The method as claimed in claim 1, wherein said at least one metal selected from the group consisting of Co and Ni is in an amount from 12 to 20 percent by weight.

8. The method as claimed in claim 2, wherein Al and said at least one metal selected from the group consisting of Co and Ni are in a total amount from 12 to 20 percent by weight which includes the Al in an amount of from 0.01 to 1.2 percent.

9. The method as claimed in claim 1 or claim 2, wherein said pressure of nitrogen atmosphere is from 1 to 10 torr.

10. The method as claimed in claim 1 or claim 2, wherein said sintering temperature is from 1430° to 1480° C.

11. A cermet manufactured by the steps of:

(a) preparing a mixed powder consisting essentially of:

titanium nitride, from 25 to 50 percent by weight;

titanium carbide, from 10 to 30 percent by weight;

at least one compound selected from the group consisting of tantalum carbide, niobium carbide, and zirconium carbide, from 5 to 25 percent;

tungsten carbide, from 10 to 25 percent by weight; and at least one metal selected from the group consisting of Co and Ni, from 7.5 to 25 percent by weight;

(b) compressing the above mixed powder into a green compact; and (c) sintering the above green compact in a nitrogen atmosphere under a pressure within a range from 0.1 to 100 torr, and at a temperature within a range from 1400° to 1550° C., said cermet having a hard disperse phase which comprises two phases, namely a first phase having a core/shell structure which is formed of a NaCl-type solid solution phase with titanium carbide at the center surrounded by a solid solution of tungsten carbide, titanium carbide, titanium nitride and at least one compound selected from the group consisting of tantalum carbide, niobium carbide, and zirconium carbide, and a titanium nitride second phase; and a binder phase comprising at least one metal selected from the group consisting of Co and Ni.

12. A cermet manufactured by the steps of:

(a) preparing a mixed powder consisting essentially of:

titanium nitride, from 25 to 50 percent by weight;

titanium carbide, from 10 to 30 percent by weight;

at least one compound selected from the group consisting of tantalum carbide, niobium carbide, and zirconium carbide, from 5 to 25 percent;

tungsten carbide, from 10 to 25 percent by weight; and (i) at least one metal selected from the group consisting of Co and Ni, and (ii) Al, in a total amount from 7.5 to 25 percent by weight;

(b) compressing the above mixed powder into a green compact; and (c) sintering the above green compact in a nitrogen atmosphere under a pressure within a range from 0.1 to 100 torr, and at a temperature within a range from 1400° to 1550° C., said cermet having a hard disperse phase which comprises two phase, namely a first phase having a core/shell structure which is formed of a NaCl-type solid solution phase with titanium carbide at the center surrounded by a solid solution of tungsten carbide, titanium carbide, titanium nitride and at least one compound selected from the group consisting of tantalum carbide, niobium carbide, and zirconium carbide, and a titanium nitride second phase; and a binder phase comprising at least one metal selected from the group consisting of Co and Ni, in which are dispersively present fine grains of intermetallic compounds of Al and Ti and at least one metal selected from the group consisting of Co and Ni.

13. The method as claimed in claim 2 wherein, Al and at least one metal selected from the group consisting of Co and Ni is in an amount from 12 to 20 percent by weight which includes the Al in an amount of from 0.01 to 1.0 percent.

14. The method as claimed in claim 11 wherein, said titanium nitride is in an amount from 30 to 45 percent by weight;

said titanium carbide is in an amount from 15 to 25 percent by weight;

said at least one compound selected from the group consisting of tantalum carbide, niobium carbide and zirconium carbide is in an amount from 10 to 15 percent by weight;

said tungsten carbide is in an amount from 10 to 20 percent by weight; and said at least one metal selected from the group consisting of Co and Ni is in an amount from 12 to 20 percent by weight.

15. The method as claimed in claim 12 wherein, said titanium nitride is in an amount of 30 to 45 percent by weight;

said titanium carbide is in an amount from 15 to 25 percent by weight;

said at least one compound selected from the group consisting of tantalum carbide, niobium carbide and zirconium carbide is in an amount from 10 to 15 percent by weight;

said tungsten carbide is in an amount from 10 to 20 percent by weight;

said at least one metal selected from the group consisting of Co and Ni is in an amount from 12 to 20 percent by weight; and the total of Al and said at least one metal selected from the group consisting of Co and Ni are in a total amount from 12 to 20 percent by weight which includes the Al in an amount of from 0.01 to 1.2 percent.

* * * * *